US005372189A

United States Patent [19]

Tsunekawa et al.

[11] Patent Number: 5,372,189

[45] Date of Patent: Dec. 13, 1994

[54] AIR CONDITIONER

[75] Inventors: Shyoji Tsunekawa, Nitta; Koji MOri, Kenoshinmachi; Yoshiki Ikari, Ashikaga; Toshimasa Tsukui, Sakai; Toshiyuki Komuro, Ora; Fujio Suzuki, Ota, all of Japan

[73] Assignee: Sanyo Electric Co., Ltd., Moriguchi, Japan

[21] Appl. No.: 76,395

[22] Filed: Jun. 14, 1993

[30] Foreign Application Priority Data

Jun. 19, 1992 [JP] Japan ..... 4-161294

[51] Int. Cl.[5] ..... F25B 29/00

[52] U.S. Cl. ..... 62/262; 62/263; 62/427; 62/410; 62/411; 165/59

[58] Field of Search ..... 62/262, 263, 427, 410, 62/411, 412; 165/59

[56] References Cited

U.S. PATENT DOCUMENTS

| | | | |
|---|---|---|---|
| 3,519,069 | 7/1970 | Green | 62/262 |
| 3,659,432 | 5/1972 | Selhost | 62/262 |
| 3,792,593 | 2/1974 | Loos et al. | 62/262 |
| 3,826,105 | 7/1974 | Marsteller | 62/262 |
| 3,940,215 | 2/1976 | Hori et al. | 62/262 |
| 4,090,373 | 5/1978 | Lang et al. | 62/262 |
| 4,478,053 | 10/1984 | Yano et al. | 62/262 |
| 4,524,588 | 6/1985 | Bond | 62/262 |
| 4,637,223 | 1/1987 | Hosoya et al. | 62/263 |
| 4,679,494 | 7/1987 | Katayama et al. . | |
| 4,869,075 | 9/1989 | Ikari et al. | 62/262 |
| 5,295,531 | 3/1994 | Tsunekawa et al. | 62/262 |

FOREIGN PATENT DOCUMENTS

| | | |
|---|---|---|
| 52-8296 | 2/1977 | Japan . |
| 4-14248 | 3/1992 | Japan . |

*Primary Examiner*—John K. Ford
*Attorney, Agent, or Firm*—Darby & Darby

[57] ABSTRACT

An integral type air conditioner intended to suppress the reduction in air conditioning ability to the utmost, even in introducing open air, includes a partitioning plate for partitioning the interior of the main body into an indoor side chamber and the outdoor side chamber. There is provided a suction port for introducing an air in the outdoor side chamber into the indoor side chamber, and a damper positioned in the outdoor side chamber for opening/closing the suction port. In the indoor side chamber, there are provided a cross-flow fan and a rear casing of the cross-flow fan. Further, on the windward side portion of the rear casing, there is provided auxiliary suction ports that communited with the suction port.

7 Claims, 4 Drawing Sheets

AIR CONDITIONER

BACKGROUND OF THE INVENTION

The present invention relates to an integral type air conditioner wherein the interior of a main body is partitioned into an indoor side chamber and an outdoor side chamber by means of a partitioning plate, and particularly to the structure for introducing the outdoor air (open air) into the interior of a room.

Conventionally, there has been disclosed an air conditioner capable of taking the open air in the interior of a room, for example, in Japanese Utility Model Publication No. sho 52-8296. In this air conditioner, the interior of the air conditioner is partitioned into an indoor side chamber and an outdoor side chamber by means of a partitioning plate. The outdoor air is sucked from suction ports opened on both sides of the outdoor side chamber by an outdoor blower (propeller fan), followed by being cooled or heated by means of an outdoor heat exchanger, and discharged from the central portion on the rear side of the outdoor side chamber. On the other hand, the indoor air is sucked from the lower portion of the indoor side chamber by an indoor blower (a cross-flow fan), followed by being cooled or heated by an indoor heat exchanger, and supplied in the interior of a room from the upper and central portion.

The partitioning plate described above is provided with an opening which is opened/closed by a damper. When the opening is opened by operation of the damper, part of the outdoor air is allowed to flow in the indoor side chamber and is mixed with the indoor air, to be thus supplied from a blow-off port into the interior of a room.

Also, there has been described an air conditioner including an electric heater on the rear side of an indoor heat exchanger in Japanese Patent Publication No. hei 4-4248. In this air conditioner, an air suction port and an air blow-off port are respectively provided on the lower portion and the upper portion, and a heat exchanger, electric heater, cross-flow fan and the above air blow-off port are disposed from the above air suction port side in this order. The above air suction port is partitioned from the above air blow-off port by means of a partitioning plate provided on the upper portion of the above heat exchanger. The electric heater is disposed on the lower side of the cross-flow fan.

However, as in the Former prior art, Japanese Utility Model Publication No. sho 52-8296, in the case of that the opening of the partitioning plate is opened to introduce the outdoor air in the interior of a room, when the damper is moved on the indoor side, a part of the ventilation passage on the indoor side is blocked by the damper. By the partial blocking of the ventilation passage, the ventilation resistance or the ventilation passage in the indoor side chamber is increased. Consequently, the amount of the indoor air to be sucked in the ventilation passage is decreased, which causes a disadvantage of reducing the air conditioning ability of the air conditioner.

SUMMARY OF THE INVENTION

To solve the above problem, the present invention has been made, and its object is to provide an air conditioner capable of suppressing the reduction in the air conditioning ability to the utmost even in introducing the open air.

In a preferred mode of the present invention, there is provided an air conditioner wherein the interior of a main body is partitioned into an indoor side chamber and an outdoor side chamber. The above partitioning plate is provided with a suction port for introducing an air from the outdoor side chamber to the indoor side chamber, and a damper positioned at the outdoor side chamber for opening/closing the auction port. A cross-flow fan and a rear casing for this cross-flow fan are provided in the indoor side chamber, and auxiliary suction ports communicated to the above suction port are provided on the windward side of the rear casing.

With this construction, when the auction port is opened by the damper for introducing the fresh air to the interior of a room, the outdoor air in the outdoor side chamber is introduced into the indoor side chamber through the suction port and the auxiliary suction ports. The fresh air flow is joined to the indoor air flowing along the rear casing of the cross-flow fan on the windward side of the above cross-flow ran.

DETAILED DESCRIPTION OF THE PREFERRED EMBODIMENT

Hereinafter, embodiments of the present invention will be described with reference to the drawings.

Figure 1:
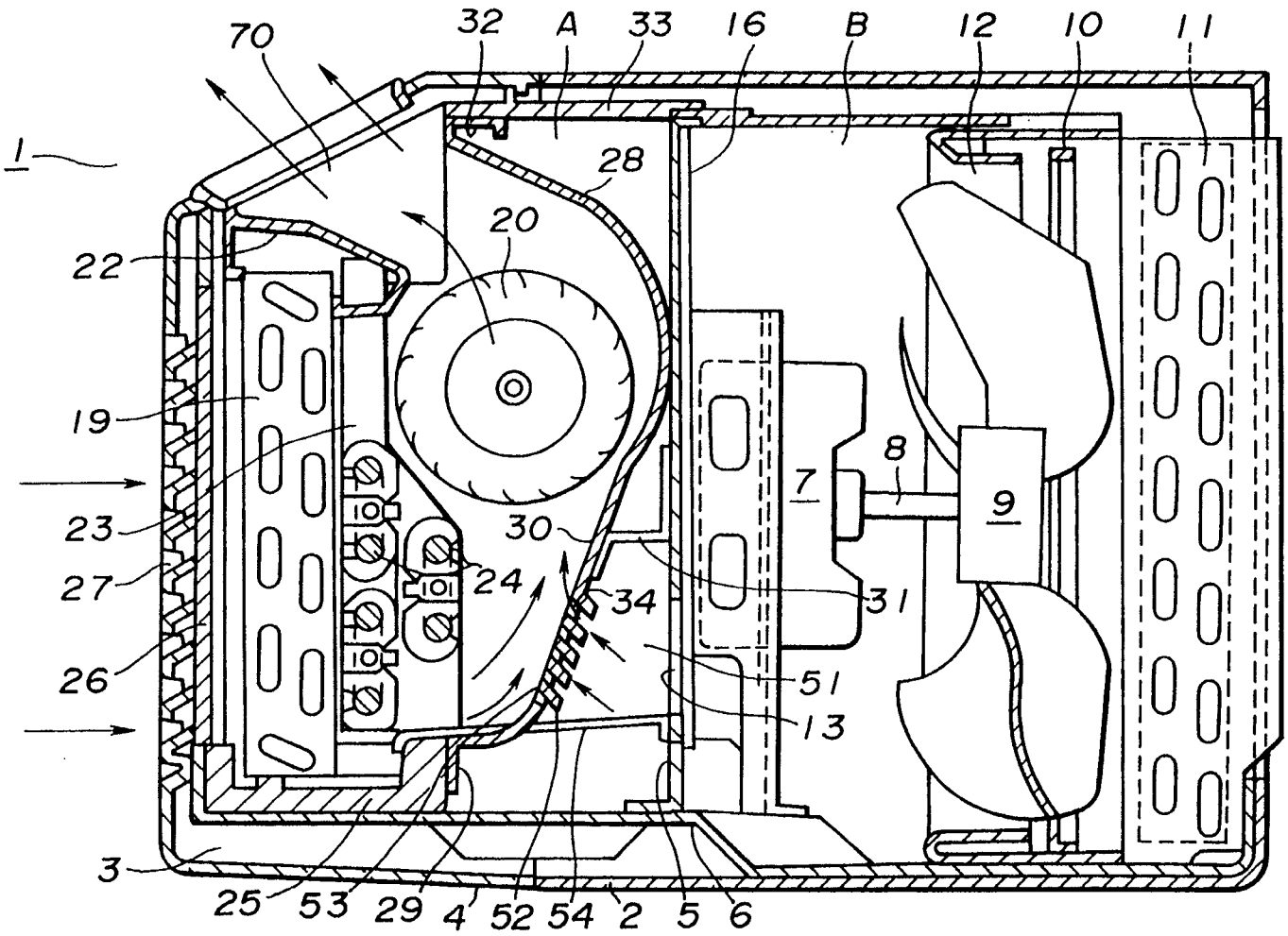
FIG. 1 is a vertical sectional view of an integral type air conditioner according to the present invention.
Figure 2:
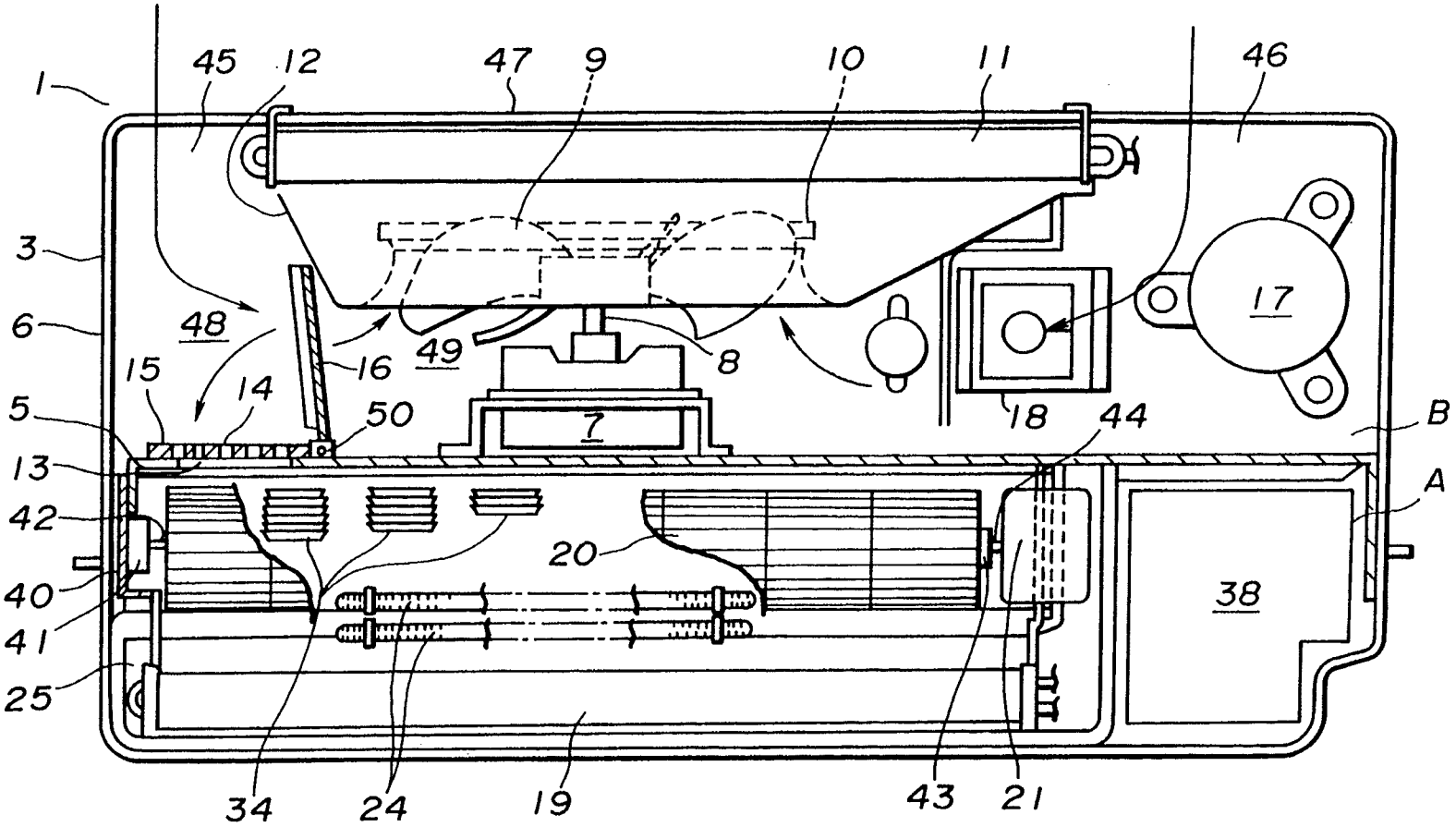
FIG. 2 is a plan view of a main body of the air conditioner according to the present invention.

In FIGS. 1 and 2, numeral 1 indicates an integral type air conditioner mounted so as to pass through a wall of a house. The air conditioner 1 is constituted of a case 2 installed so as to pass through a wall of a house, a main body 3 inserted in the case 2, and a front panel 4 mounted on the front portion of the main body 3.

Numeral 6 indicates a bottom plate of the main body 3, and 5 is a partitioning plate erected on the bottom plate 6. The partitioning plate 5 partitions the interior of the main body 3 into an indoor side chamber A and an outdoor side chamber B. Numeral 7 indicates an outdoor side motor fixed on the outdoor side wall surface of the partitioning plate 5. A rotational shaft 8 of the outdoor aide motor 7 rotates an outdoor fan, for example a propeller fan 9. An outdoor blower is constituted of the propeller fan 9, the outdoor side motor 7 and the like. Numeral 10 indicates a slinger ring mounted around the outer periphery of the propeller fan 9, and 11 is an outdoor heat exchanger for performing the heat exchange with the outdoor air (open air). The above slinger ring 10 is intended to scrape the drain water collected on the bottom plate 6 of the main body 3 in the cooling operation and to scatter it to the outdoor heat exchanger 11.

Figure 3:
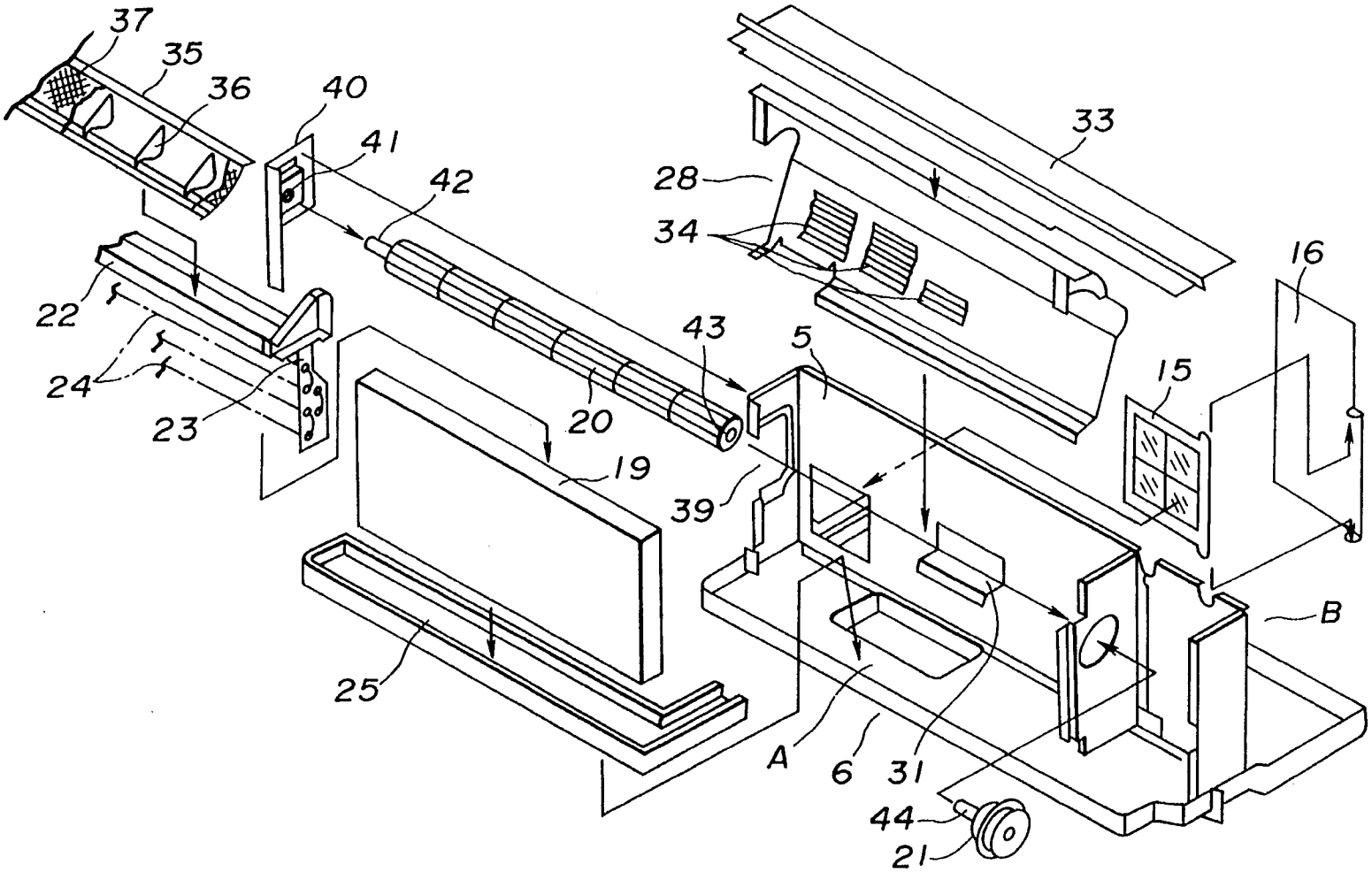
FIG. 3 is an exploded view in perspective of each apparatus disposed in an indoor side chamber of the main body of the air conditioner according to the present invention.

Numeral 12 indicates a fan casing covering a part of the propeller fan 9. The fan casing 12 is connected to the outdoor heat exchanger 11. Numeral 13 indicates a auction port provided on one side (left side, in FIG. 2) of the partitioning plate 5 for introducing fresh air. A suction frame 15 made of synthetic resin stretching an insect proof net 14 is provided on the surface of the suction port 13 on the side of the outdoor side chamber B. The damper 16 is supported on the suction frame 15 in a manner to be mounted as shown in the arrow of FIG. 3.

Numeral 17 indicates a compressor, and 18 is a drain pump, which are disposed in the outdoor side chamber B on the side (opposite right side, in FIG. 2) to the side where the damper 16 is provided.

Numeral 19 indicates an indoor heat exchanger for performing the heat exchange with indoor air, and 20 is a cross-flow fan, used as an indoor fan disposed on the rear side of this indoor heat exchanger 19. Numeral 21 indicates an indoor side motor for driving the cross-flow fan 20, and 22 is a stabilizer serving as a partitioning plate disposed on the upper portion of the indoor heat exchanger 19.

A heater supporting device 23 is hung from the stabilizer 22. In the heater supporting device 23 having the lower portion formed to be wider than the upper portion, electric heaters 24 and 24 are juxtaposed to each other. Accordingly, the electric heater positioned on the partitioning plate 22 side is situated under the cross-flow fan 20. Numeral 25 indicates an indoor drain pan disposed under the indoor heat exchanger 19, and 26 is an air filter. The air filter 26 is disposed on the rear side of a suction grill (air suction port) 27 of the front panels 4 and also on the front side of the indoor heat exchanger 19.

Numeral 28 indicates a rear casing of the cross-flow fan 20, wherein a lower end portion 29 is fixed at the rear portion of the an indoor drain pan 25, a central portion 30 being fixed at a positioning piece 31 provided to be projected from the partitioning plate 5 to the indoor side chamber A, and the upper end portion 32 is fixed at an upper plate 33. An indoor blower is constituted of the rear casing 28, cross-flow fan 20, the indoor side motor 21 and the like. Numeral 34 indicates each auxiliary suction port formed on a portion of the rear casing 28 on the windward side (seen from the cross-flow fan 20), and which is formed in a shape called a louver by cutting and rising of the plate forming the rear casing 28. Numeral 38 indicates a battery box.

FIG. 3 shows a state of mounting the apparatuses, which are disposed in the indoor side chamber A, out of the above apparatuses. The auxiliary suction ports 34 are made smaller in size gradually from the left side to the right side of the rear casing 28. Numeral 35 is a wind direction changing member mounted on the upper surface of the stabilizer 22 (omitted, in FIG. 1). The wind direction changing member 35 is constituted of wind direction changing blades 36, and a wire net 37 disposed on the front side of the wind direction changing blades 36 for preventing the insertion of the fingers.

Numeral 39 indicates a checking portion (checking port) used for service checking of the cross-flow fan 20 and the electric heaters 24. The checking portion 39 is closed by an auxiliary plate 40 touched from the outside thereof (left side, in FIG. 3). The auxiliary plate 40 is mounted with a bearing 41 which supports a non-drive shaft 42 of the cross-flow fan 20. Numeral 43 is a boss of the cross-flow fan, and which is mounted with a rotational shaft 44 of the indoor side motor 21.

In the integral type air conditioner 1 having such a construction, the compressor 17, the outdoor heat exchanger 11, a pressure reduction device (not shown), the indoor heat exchanger 19 and the like are sequentially connected in communication to each other. In the cooling operation, the outdoor heat exchanger 11 actuates as a condenser, and the indoor heat exchanger 19 actuates as an evaporator.

When the propeller fan 9 in the outdoor side chamber B is rotated by driving of the outdoor side motor 7, outdoor air is sucked from the suction ports 45 and 46 formed on the right and left sides of the back surface of the outdoor side chamber B into the outdoor side chamber B, followed by being cooled or heated in the outdoor heat exchanger 11, and is discharged from the central portion 47 on the back surface of the outdoor side chamber B (see the solid line arrows in FIG. 2).

Also, in the indoor side chamber A, when the cross-flow fan 20 is rotated by driving of the indoor side motor 21, indoor air is sucked through the front surface of the indoor side chamber A, that is, through the suction grill 27 of the front panel 4 into the indoor side chamber A, followed by being cooled or heated in the indoor heat exchanger 19, and is then blown out from a discharge port 70 provided on the upper portion of the front panel 4 (see the solid line arrows in FIG. 1).

At this time, the damper 16 is not opened, that is, it is contacted with the surface of the insect proof net 14 on the outdoor side chamber B side, at the suction port 13 of the partitioning plate 5, thereby closing the suction port 13. Thus, the indoor side chamber A is separated from the outdoor side chamber B. In the outdoor side chamber B, a fresh air introducing passage 48 extending from one suction port 45 to the suction port 13 is connected to an open air discharging passage 49 extending from the open air introducing passage to the outdoor heat exchanger 11 (see FIG. 2).

Next, for introducing fresh air into the indoor side chamber A, by manually operating a switching lever (not shown) provided on the side portion of the main body 3, the damper 16 is rotated around the supporting shaft 50 thereof by the tension of this lever. Thus, the leading edge portion of the damper 16 is made to be close to or to be abutted on the wall surface of a fan case 12, thus blocking the flow of the fresh air flowing in the the open air introducing passage 48 as described above to the open air discharging passage 49. On the other hand, the fresh air introducing passage 48 communicate with the indoor side chamber A through the insect proof net 14 (see FIG. 2).

When the outside air introducing passage 48 (that is, the suction port 45) communicate with the indoor side chamber A as described above, the fresh air is sucked in the suction port 13 of the partitioning plate 5 to flow into the indoor side chamber A by the negative pressure generated by the rotation of the cross-flow fan 20, and is introduced to the inside (front side) of the rear casing 28 from the auxiliary suction ports 34 through an intermediate space 51 between the partitioning plate 5 and the rear casing 28. The fresh air is then blown off from the discharge port 70 to the interior of a room together with the indoor air in the indoor side chamber A flowing by the rotation of the cross-flow fan 20 in the indoor side chamber A.

In this case, each of the auxiliary suction ports 34 is formed in a louver shape by cutting and raising of the windward intake side portion of the rear casing 28, and each of the raised pieces 52 projects outwardly (rear side, that is, partitioning plate 5 side) of the rear casing 28, so that the inner wall 53 of the rear casing 28 is substantially kept in the smooth curve shape. Accordingly, in thus introducing the fresh air, a ventilation resistance in the indoor ventilation passage as shown in the prior art is made smaller, and the flow of indoor air in the indoor ventilation passage formed of the rear casing 28 and the like is made to be smooth substantially as in the ordinary cooling (without fresh air) operation (see the solid line arrows of FIG. 1) Thus it is possible to suppress the reduction in the air conditioning ability of the air conditioner 1 to the utmost in introducing the fresh air.

Also, even if the drain water and rain water scraped up by the slinger ring 10 in the indoor side chamber B adhere on the rear casing 28 through the suction port 13, since each of the auxiliary suction ports is formed in the louver shape by cutting and bending of the rear casing 28, there is little fear of permeation of these waters into the ventilation passage in the indoor side chamber A. Accordingly, there is no risk of adhesion of the drain water and rain water on the electric heater 24, thus eliminating the fear of causing an insulation failure of the electric heaters 24 and the like by these waters. In addition, in the case where drain water and rain water permeate from the suction port 13, they are introduced to the indoor drain pan 25 through a drain guide gutter 54 disposed so as to be put between the suction port 13 and the indoor drain pan 25, to be thus discharged.

Figure 4:
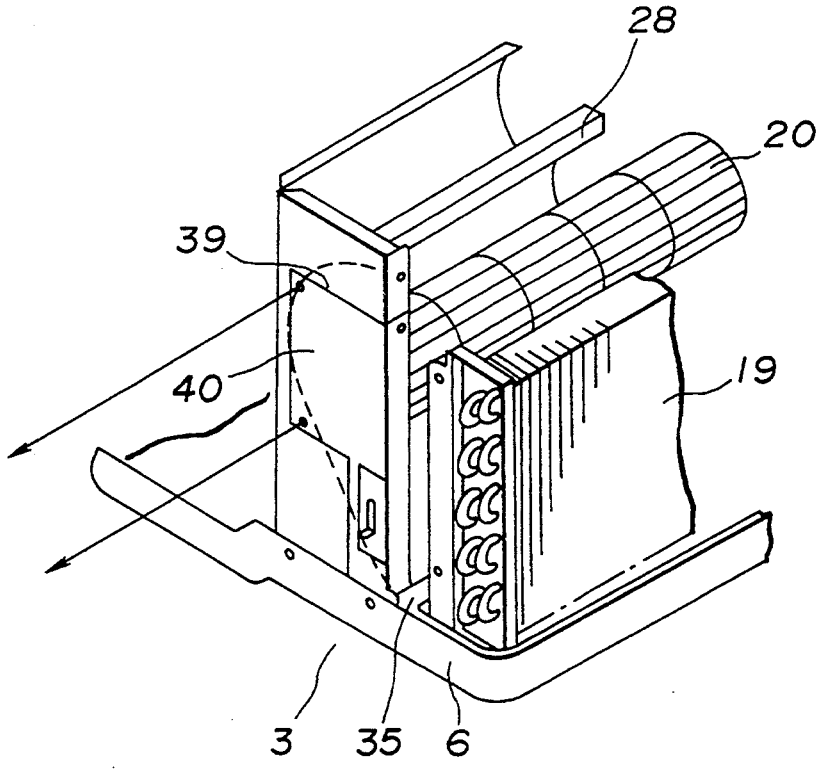
FIG. 4 is a perspective view showing the main part of the main body of the air conditioner according to the present invention.

In this case, during the service checking of the electric heaters 24, cross-flow fan 20 and the like, first, the front panel 4 is removed, and the main body 3 is drawn from the case 2. After that, the auxiliary plate 40 is removed as shown in the solid line arrow of FIG. 4, so that the non-drive shaft 42 of the cross-flow fan 20 supported by the bearing 41 of the auxiliary plate 40 is removed. Next, the boss 43 on the drive side of the cross-flow fan 20 is loosen and removed from the rotational shaft 44 of the indoor side motor 21, and the cross-flow fan 20 is drawn from the checking portion 39 along the axial direction of the fan 20.

After the cross-flow fan 20 is thus removed from the main body 3, the stabilizer 22 disposed on the upper portion of the indoor heat exchanger 19 is removed upwardly (in the opposed direction to that shown in the solid line arrow of FIG. 3). By the removal of the stabilizer 22, the heater supporting piece 23 hung by the stabilizer 22 and the electric heaters 24 fixed to the supporting piece 23 can be integrally removed. Accordingly, even when the electric heaters 24 are disposed under the cross-flow fan 20, there may be no trouble in service checking them. Also, since the width dimension of the upper portion of the heater supporting piece 23 is set to be smaller than that of the electric heaters 24 juxtaposed in two lines, it is possible to make smaller the gap between the heat exchanger 19 and the cross-flow fan 20 than the width dimension of the electric heaters 24 and 24 juxtaposed in two lines, and hence to make smaller the depth dimension of the main body 3.

As described above, according to the present invention, the interior of the main body of the air conditioner is partitioned into the indoor side chamber and the outdoor side chamber by means of the partitioning plate. The partitioning plate is provided with the suction port for communicating both chambers with each other, and the damper is positioned in the indoor side chamber for opening/closing the suction port and for introducing air in the outdoor side chamber into the indoor side chamber. Further, the rear casing of the cross-flow fan is provided in the indoor side chamber, and the auxiliary suction ports that communicated to the suction port of the partitioning plate are provided on the windward side of the rear casing. Accordingly, the open air is smoothly joined to the indoor air flowing along the rear casing. Also, since the damper does not block the flow of the indoor air, it is possible to suppress the reduction in the air conditioning ability of the air conditioner to the utmost.

What is claimed is:

1. An air conditioner wherein the inside of a body is separated into an outdoor side chamber and an indoor side chamber by a partitioning plate, comprising:

an indoor heat exchanger provided in said indoor side chamber for exchanging heat with indoor air;

an indoor blower provided in said indoor side chamber, said blower including at least a cross-flow fan having an intake side and a rear casing of said cross-flow fan, said blower circulating said indoor air through said indoor heat exchanger, an intermediate space being defined between said partitioning plate and said rear casing;

auxiliary suction ports provided on a portion of said rear casing, said auxiliary suction ports communicating between said intermediate space and said fan intake side;

an outdoor heat exchanger provided in said outdoor side chamber for heat exchanging with outdoor air;

an outdoor blower provided in said outdoor side chamber for obtaining outdoor air through a plurality of suction ports and circulating said outdoor air through said outdoor heat exchanger;

a suction port provided in said partitioning plate for allowing a flow of air from said outdoor side chamber into said intermediate space in said indoor side chamber; and a damper provided in said partitioning plate for selectively opening and closing said suction port;

opening said suction port by said damper introducing a portion of the air in said outdoor side chamber into said indoor side chamber through said suction port and via said auxiliary suction ports and intermediate space, said portion flowing to said intake side of said cross-flow fan by a negative pressure generated by rotation of said cross-flow fan, said indoor air mixing with said outdoor air portion at said intake side of said fan, and the damper, upon opening said suction port, communicating a part of said suction port to said indoor side chamber and blocking the space between a part of said suction port and said outdoor heat exchanger.

2. An air conditioner according to claim 1, wherein said damper is provided on the surface of said partitioning plate on the outdoor side, and is pivoted in said outdoor side chamber to open said suction port.

3. An air conditioner as in claim 1, wherein said auxiliary suction ports are spaced apart in an axial direction of said cross-flow fan.

4. An air conditioner wherein the inside of a body is separated into an outdoor side chamber and an indoor side chamber by a partitioning plate, comprising:

an indoor heat exchanger provided in said indoor side chamber for exchanging heat with indoor air;

an indoor blower provided in said indoor side chamber, said blower including at least a cross-flow fan having an intake side and a rear casing of said cross-flow fan, said blower circulating said indoor air through said indoor heat exchanger, an intermediate space being defined between said partitioning plate and said rear casing;

auxiliary suction ports on a portion of said rear casing each formed by cutting and raising of a respective portion of said rear casing on said partitioning plate side, said auxiliary suction ports communicating between said intermediate space and said fan intake side;

an outdoor heat exchanger provided in said outdoor side chamber for heat exchanging with outdoor air;

an outdoor blower provided in said outdoor side chamber for circulating said outdoor air through said outdoor heat exchanger;

a suction port provided in said partitioning plate for allowing a flow of air from said outdoor side chamber into said intermediate space in said indoor side chamber; and a damper provided in said partitioning plate for selectively opening and closing said suction port;

opening said suction port by said damper introducing a portion of the air in said outdoor side chamber into said indoor side chamber through said suction port and via said auxiliary suction ports and intermediate space, said portion flowing to said intake side of said cross-flow fan by a negative pressure generated by rotation of said cross-flow fan, said indoor air mixing with said outdoor air portion at said intake side of said fan.

5. An air conditioner according to claim 4, wherein said auxiliary suction ports include cut openings which are oriented along an axial direction of said cross-flow fan.

6. An air conditioner according to claim 4, wherein the total flow area of said auxiliary suction ports is larger than the flow area of said suction port.

7. An air conditioner according to claim 4, wherein the cut and raised portions of said auxiliary suction ports of said rear casing guide the air in the intermediate space between said rear casing and said partitioning plate to flow to said cross-flow fan.

* * * * *